US005435043A

United States Patent [19]

Ito et al.

[11] Patent Number: 5,435,043

[45] Date of Patent: Jul. 25, 1995

[54] FEMALE MEMBER OF SNAP BUTTON AND PRESS TOOL FOR CLINCHING THE SAME TO WASHER

[75] Inventors: Kazuyoshi Ito; Yoshio Takamura; Hirokazu Watanabe, all of Kurobe, Japan

[73] Assignee: Yoshida Kogyo K.K., Tokyo, Japan

[21] Appl. No.: 156,738

[22] Filed: Nov. 24, 1993

[30] Foreign Application Priority Data

Nov. 30, 1992 [JP] Japan ..... 4-319995

[51] Int. Cl.[6] ..... A44B 1/00

[52] U.S. Cl. ..... 24/114.4; 24/114.5; 24/689

[58] Field of Search ..... 24/90 R, 90 C, 674, 24/689

[56] References Cited

U.S. PATENT DOCUMENTS 1,981,345 11/1934 Carr .
4,509,232 4/1985 Kanzaka ..... 24/689
4,512,063 4/1985 Fukuroi ..... 24/689
4,698,881 10/1987 Watanabe ..... 24/674
5,101,541 4/1992 Watanabe .

FOREIGN PATENT DOCUMENTS 619279 3/1927 France .
800977 7/1936 France .
4-43112 4/1992 Japan .
4-37450 9/1992 Japan .
29115 12/1911 United Kingdom .

*Primary Examiner*—Victor N. Sakran
*Attorney, Agent, or Firm*—Hill, Steadman & Simpson

[57] ABSTRACT

A snap button includes a female member and a male member engageable therewith. The female member comprises a hollow cylindrical body including a cylindrical hub and an annular flange extending radially outwardly from and integrally formed with the lower end of the cylindrical hub and terminating in a flat rim, the annular flange having an annular abutting portion formed between the lower end of the cylindrical hub and the flat rim, the flat rim and the annular abutting portion being spaced axially of the hollow cylindrical body; an annular cap having a through hole formed centrally therethrough to define an inner rim therearound and an outer folded brim formed around the outer edge, the folded outer brim coming into gripping engagement with the annular flange so that the annular cap is fastened to the hollow cylindrical body with an inner surface of the annular cap abutting on the abutting portion and with an annular space provided between the lower end of the cylindrical hub and the inner rim of the annular cap; and an annular spring disposed in the annular space.

2 Claims, 5 Drawing Sheets

FEMALE MEMBER OF SNAP BUTTON AND PRESS TOOL FOR CLINCHING THE SAME TO WASHER

BACKGROUND OF THE INVENTION

1. Field of the Invention

The present invention relates to a socket or female member of a snap button made of metal fastened to clothing, baggages, etc. and a press tool for fastening the female member to a fabric piece, etc. composing the above-mentioned articles.

2. Description of the Prior Art

A typical snap button female member of the type described is disclosed in Japanese Utility Model Publication No. 4-37450. The disclosed female member comprises a cylindrical body having one end slightly flared to provide a space, an annular spring disposed in the space and a cap having its peripheral edge folded thereon and fastened to the one end of the cylindrical body with the annular spring disposed in the space.

Another snap button female member is disclosed in the U.S. Pat. No. 5,101,541. The female member comprises a cylindrical collet including a central through opening, an annular flange extending radially outwardly from the collet, an annular spring received in the collet and a cylindrical hub having its lower marginal edge flared to form an anchoring lug. The annular flange has a first and second series of ridges formed on its upper surface, the first series of ridges folded over the spring to retain the spring on the collect and the second series of ridges also folded over the the anchoring lug of the cylindrical body to fastening the cylindrical hub to the collet.

The first type of conventional female member has a drawback in that, when the female member is clinched to a fabric piece of clothes or a baggage, clinching forces focus on the joint between the cylindrical body and the cap and are likely to deform the cylindrical body and the cap there, thereby causing a gap between the cylindrical body and the cap. As a result, the cylindrical body and the cap are inclined to turn relative to each other, which is prone to cause unravelling of the edge of the hole to which the female member is attached. Furthermore, if too strong forces are exerted on the cap, the end of cylindrical body is squeezed to cause the spring stuck to the cylindrical body, leading to malfunction of the snap button.

The second type of conventional female member has a drawback in that it is complex in construction and bulky so that it cost much and its manufacture and assemble takes much time.

SUMMARY OF THE INVENTION

With the foregoing difficulties in view, it is therefore an object of the present invention to provide a female member of a snap button which is simple in construction, and easy to manufacture and assemble and which can endure strain caused by the operation of clinching the female member to a fabric piece without permanent deformation.

It is another object of the present invention to provide a press tool for clinching a female member to a fabric piece which press tool does not deform a spring-containing part of the female member when clinching the female member to the fabric piece.

According to one aspect of the present invention, there is provided, in a snap button including a female member and a male member engageable therewith, the female member comprising a hollow cylindrical body including a cylindrical hub and an annular flange extending radially outwardly from and integrally formed with the lower end of the cylindrical hub and terminating in a flat rim, the annular flange having an annular abutting portion formed between the lower end of the cylindrical hub and the flat rim, the flat rim and the annular abutting portion being spaced axially of the hollow cylindrical body; an annular cap having a through hole formed centrally therethrough to define an inner rim therearound and an outer folded brim formed around the outer edge, the folded outer brim coming into gripping engagement with the annular flange so that the annular cap is fastened to the hollow cylindrical body with an inner surface of the annular cap abutting on the abutting portion and with an annular space provided between the lower end of the cylindrical hub and the inner rim of the annular cap; and an annular spring disposed in the annular space.

According to a second aspect of the present invention, there is provided a press tool for clinching a female member of a snap button to a washer, the press tool comprising a die including a cylindrical central platform projecting upwardly from an upper surface thereof, an annular step formed in the outer peripheral wall of the cylindrical platform for receiving an annular spring and an annular cavity formed around the central platform and disposed slightly lower the step for receiving an annular cap; and a punch including a cylindrical boss projecting downward from a lower surface thereof, an annular curling groove formed immediately outside around the cylindrical boss for curling a cylindrical hub and a washer-receiving surface formed around the curling groove for retaining a washer, the cylindrical boss, the annular curling groove and the washer-receiving surface of the punch being substantially in vertical registry with the cylindrical platform, the annular step and the annular cavity, respectively, of the die.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRPTION OF THE INVENTION

Figure 1:
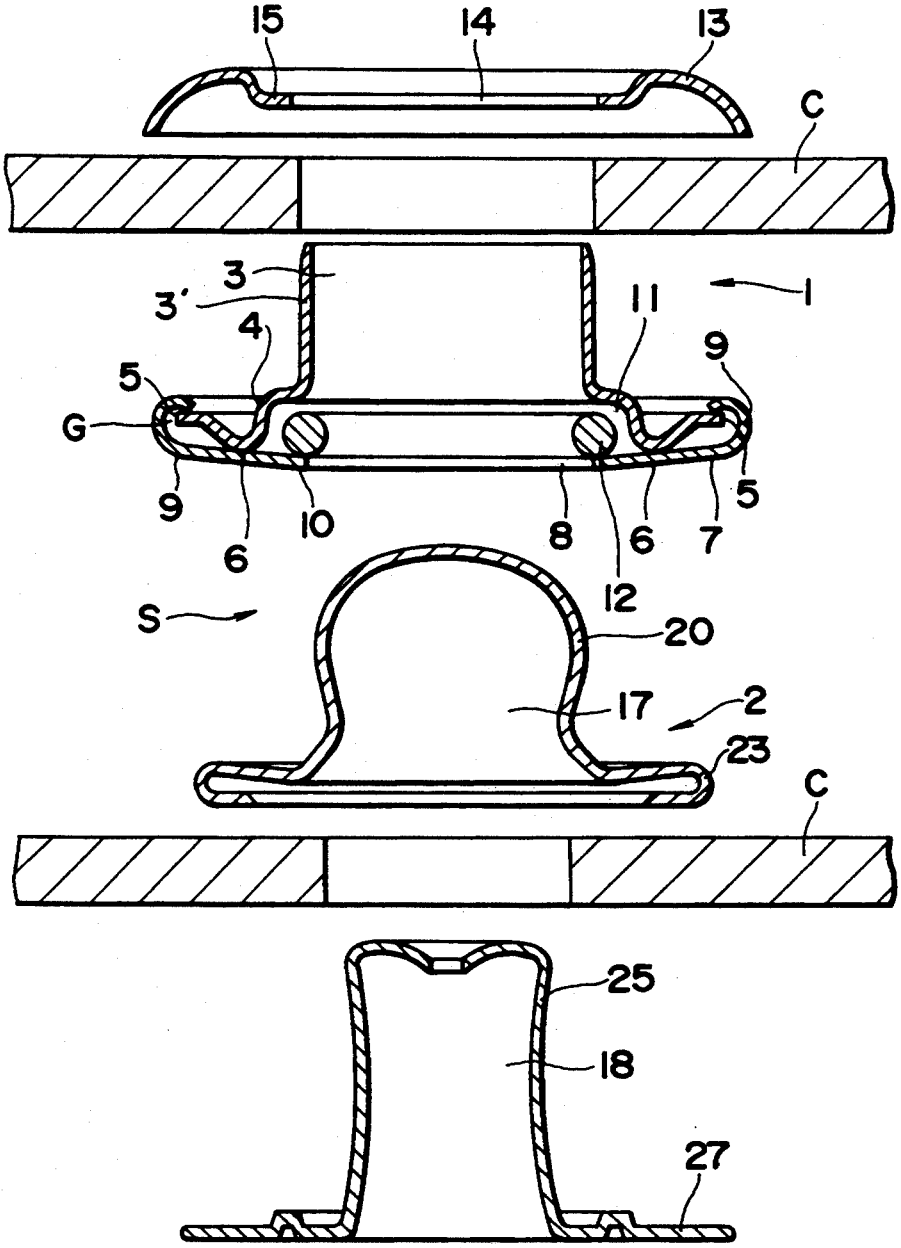
FIG. 1 is an exploded cross-sectional view of a snap button incorporating, among others, a female member according to a first embodiment of the present invention.

Referring now to the drawings and FIG. 1 in particular, there is shown a snap button S which is used on clothes, a baggage, etc. The snap button S broadly comprises a socket or female member 1 and a plug or male member 2 engageable therewith.

The female member 1 generally comprises a hollow cylindrical body 3, an annular flat cap 7, an annular spring 12 and an annular washer 13.

The hollow cylindrical body 3 includes a cylindrical central hub 3' and an annular flange 4 extending radially outwardly from and integrally formed with the lower end of the cylindrical hub 3'. The annular flange 4 is undulated to thus provide a projecting annular abutting portion 6 and terminates in a flat rim 5. The flat rim 5 and the annular abutting portion 6 are spaced from each other axially of the hollow cylindrical body 3. The annular abutting portion 6 is so shaped as to provide the annular flange 4 with resiliency. For increased resiliency, the annular flange 4 may be formed with a plurality of circumferential slits therein.

The annular flap cap 7 has a central circular through hole 8 formed central therethrough to thus provide an inner annular rim 10. An enlarged bulb portion 20 of the male member 2 is releasably inserted through the circular through hole 8, as closely described hereinafter. The annular flat cap 7 also has an outer folded brim 9 formed around the outer edge. The folded brim 9 comes into gripping engagement with the annular flat rim 5 so that the annular flat cap 7 is fastened to the hollow cylindrical body 3. In this instance, an inner surface of the annular flat cap 7 comes into abutting engagement with the annular abutting portion 6. The annular flange 4 of the hollow cylindrical body 3 terminates short of the inner periphery of the folded outer brim 9 of the annular flat cap 7 to thus provide a gap G between the flat rim portion 5 and the inner periphery of the folded outer brim 9 for permitting the flat rim portion 5 of the flange 4 to slide on an inner surface of the folded outer brim 9. And, the annular flange 4 is undulated to thus provide an annular space 11 between the lower end of the cylindrical hub 3' and the inner rim 10 of the annular cap 7. An annular spring 12 is disposed in the annular space 11. As shown in FIG. 1, a diameter of the central circular through hole 8 is slightly greater than an inner diameter and slightly smaller than an outer diameter of the annular spring 12, so that an inner annular half of the annular spring 12 is exposed in the through opening 8.

The annular washer 13 has a central through hole 14 formed centrally thereof for receiving the cylindrical hub 3' of the hollow cylindrical body 3. The annular washer 13 also has an annular recess 15 formed around the central through hole 14 for receiving a deformed end of the cylindrical hub 3' when the cylindrical body 3 is clinched against the annular washer 13.

Figure 2:
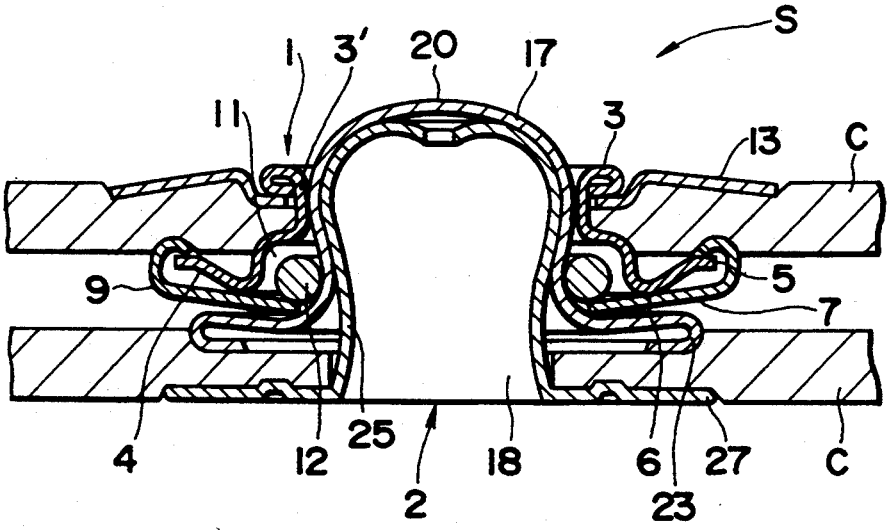
FIG. 2 is a cross-sectional view of the snap button of FIG. 1, showing the female member coming into coupling engagement with a matching male member.

The male member 2 of the snap button S comprises a front body 17 and a matching backing member 18, both being similar in cross-sectional shape, as better shown in FIG. 1. The front body 17 has an enlarged bulb portion 20 and a lower flange 23 provided radially outwardly from the lower end of the enlarged bulb 20. The backing member 18 comprises a hollow cylindrical part 25 and a lower flange 27 provided radially outwardly from the lower end of the hollow cylindrical part 25. As shown in FIGS. 1 and 2, the hollow cylindrical part 25 of the backing member 18 is first inserted through a through aperture of a fabric piece C, and then deformed and clinched into the enlarged bulb portion 20 with the fabric piece C remaining interposed between the lower flange 23 and the lower flange 27 of the front body 17 and the backing; member 18, respectively.

The enlarged bulb portion 20 of the male member 2 has an outer diameter substantially equal to an inner diameter of the cylindrical hub 3' of the female member 1 but slightly larger than n inner diameter of the annular spring 12. Thanks to such dimensional relation, the enlarged bulb portion 20 of the male member 2 fits snugly into the cylindrical hub 3' through the circular through hole 8 of the cap 7. Besides, when inserted into the female member 1, the enlarged bulb portion 20 expands the annular spring 12 radially outward against resiliency thereof and; when fully inserted into the female member 1, the enlarged bulb portion 20 is releasably retained in place by the annular spring 12 under its resiliency, as shown in FIG. 2. When the male member 2 is fully inserted into the female member 1, the enlarged bulb 20 has its tip projected beyond the annular washer 13 of the female member 1 to permit a finger or the like to have access thereto for thrusting the male member 2 out of resilient engagement with the female member 1.

Figure 3:
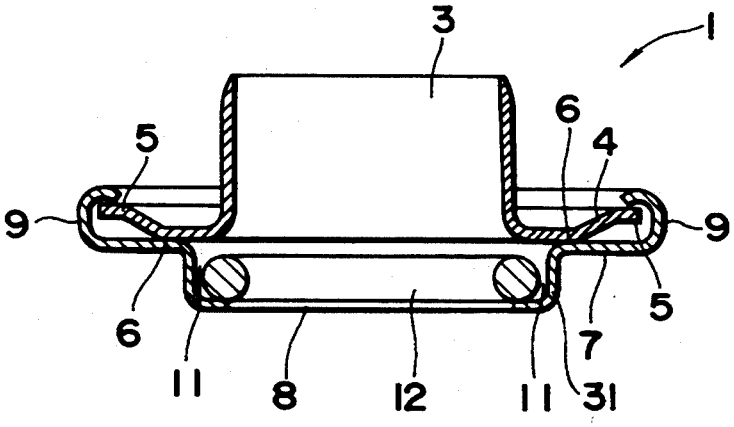
FIG. 3 is a cross-sectional view of a female member according to a second embodiment of the present invention.

FIG. 3 shows a female member 1, a washer omitted for brevity, according to a second embodiment of the present invention. This female member 1 is substantially identical with that according to the first embodiment with one exception, that is; according to this embodiment, the annular cap 7 is provided around the central through hole 8 with an annular step 31 to thus provide a space 11 for receiving the annular spring 12. Correspondingly, the flange 4 extends perpendicularly from the lower end of the cylindrical hub 3' without being undulated to thus provide a flat abutting portion 6. The flange 4 then extends slantly upward from the flat abutting portion 6 and terminates in a flat rim 5.

Figure 4:
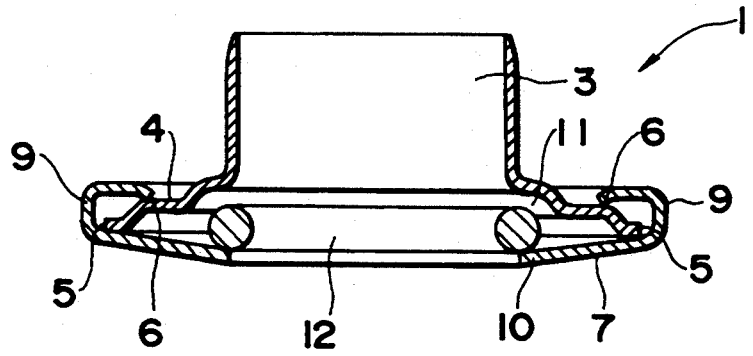
FIG. 4 is a view similar to FIG. 3, but showing a third embodiment of the present invention.

FIG. 4 shows a female member 1 according to a third embodiment of the present invention. The female member 1 according to this embodiment is substantially identical with that according to the first embodiment. The only difference resides in that the the flange 4 extends slantly downward from the lower end of the cylindrical hub 3', then extends flat to provide a flat abutting portion 6, then extends slant downwardly again and terminating in the flat rim 5. The annular flat cap 7 is fastened to the annular flange 4 of the cylindrical body 3 with an outer folded brim 9 abutting on the abutment portion 6 and the flat rim 5 of the flange abutting on the inner surface of the annular flat cap 7.

Figure 5:
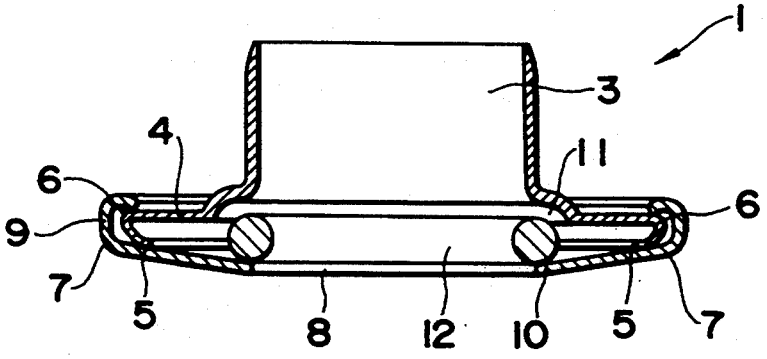
FIG. 5 is also a view similar to FIG. 2, but showing a fourth embodiment of the present invention.

FIG. 5 shows a female member 1 according to a fourth embodiment of the present invention. The female member 1 according to this embodiment is substantially identical with that according to the third embodiment except that the flange 4 extends radially outwardly form the cylindrical hub 3' and folded inward to provide an abutment portion 6 and terminating in a flat rim portion 5. Similarly to the third embodiment, the annular flange 4 of the cylindrical body 3 is fastened to the annular flat cap 7 with the abutting portion 6 and the flat rim 5 of the annular flange 4 abutting on an outer folded brim 9 and the inner surface, respectively, of the annular flat cap 7.

Description is now made about a press tool T for securing the snap button female member 1 to a fabric piece C composing clothing, a baggage or the like article.

Figure 7:
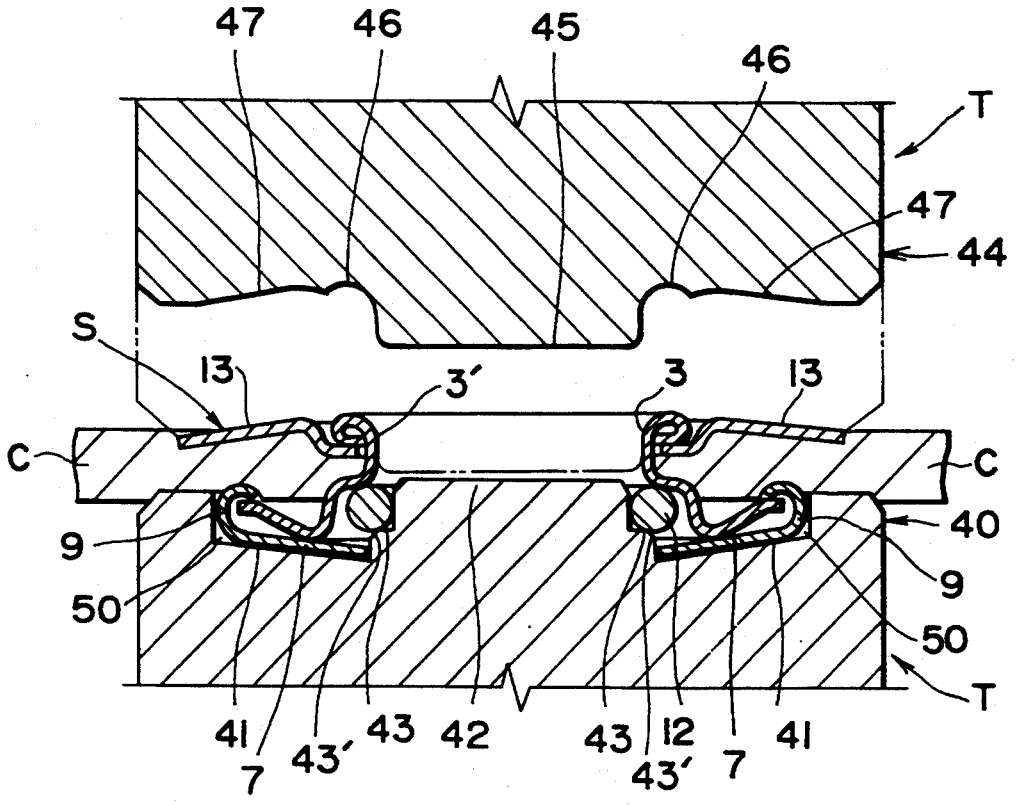
FIG. 7 is a cross-sectional view of the press tool, showing the die and a coacting punch after they have carried out the clinching operation upon the female member.

As shown in FIG. 7, the press tool T comprises a die 40 embedded in a stationary die block (not shown) and a coacting punch 44 disposed above the die 40 and mounted on a vertically reciprocal ram (not shown) for reciprocally moving toward and away from the die 40.

Figure 6:
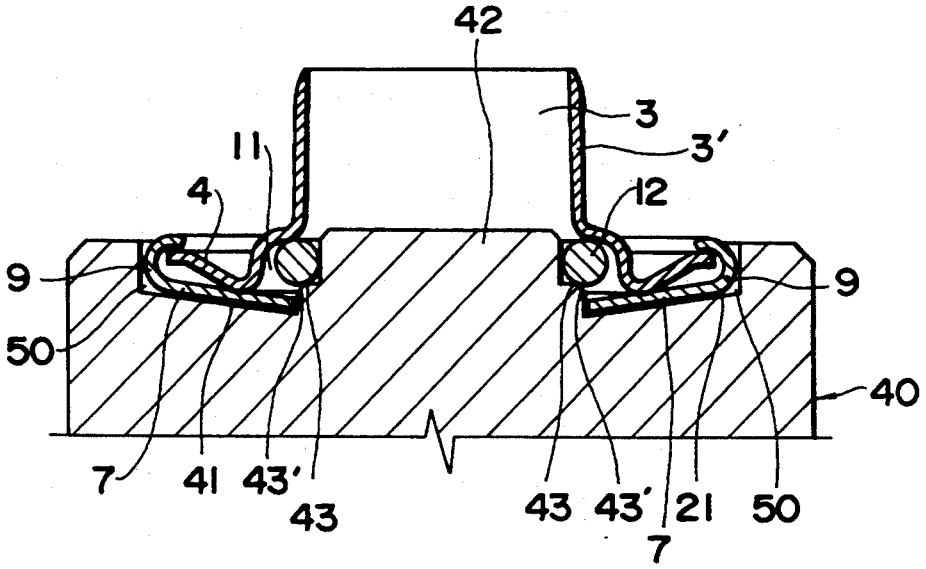
FIG. 6 is a cross-sectional view of a die of a press tool for the female member, showing the female member resting on the die before a clinching operation.

As better shown in FIG. 6, the die 40 includes a cylindrical central platform 42 integrally formed on and projecting upwardly from an upper surface thereof, an annular step 43 formed in the outer peripheral wall of the cylindrical platform 42 for receiving the annular spring 12 and an annular cavity 41 formed around the central platform 42 and disposed lower than the annular step 43 for receiving annular cap 7. The central cylindrical platform 42, the annular step 43 and the annular cavity 41 are concentric with one another.

As shown in FIG. 7, the punch 44 includes a cylindrical boss 45 integrally formed on and projecting downward from a lower surface thereof, an annular curling groove 46 formed immediately outside around the cylindrical boss 45 for curling a cylindrical hub 3' and an annular-washer-receiving surface 47 formed further outside around the curling groove 46 for retaining the annular washer 13. The central cylindrical boss 45, the annular curling groove 46 and the washer-receiving surface 47 of the punch 44 are concentric with one another and are substantially in vertical registry with the central cylindrical platform 42, the annular step 43 and the annular cavity 41, respectively, of the die 40.

An operation of the press tool T will be now described in conjunction with FIGS. 6 and 7. Before fed into to the press tool T, the annular flat cap 7 has been fastened to the annular flange 4 of the cylindrical body 3 with the annular spring 12 loosely disposed in the annular space 11. The capped cylindrical body 3 is set on the die 40 with the annular flat cap 7 embedded in the annular cavity 41 and with the annular spring 12 resting on the annular step 43.

Then, as shown in FIG. 1, the fabric piece C is placed on the capped cylindrical body 3 with the aperture of the fabric piece C snugly receiving the cylindrical hub 3'. Then, the annular washer 13 is placed on the fabric piece C with its central hole 14 through the cylindrical hub 3' of the cylindrical body 3.

Thereafter, as shown in FIG. 7, the ram is activated and the punch 44 descends toward the die 40 and curl the cylindrical hub 3' against the upper surface of the annular washer 13, thereby clinching the capped cylindrical body 3 to the annular washer 13 with the fabric piece C interposed therebetween.

Preferably, the annular step 43 may be provided at its corner with an annular chamfer 43' to deviate the pressure exerted upon the die 40 by the punch 44 radially outwardly of the cylindrical platform 42. The annular cavity 41 is slightly larger in outer diameter than the annular flat cap 7 to thus provide a gap 50 between the periphery of the annular cavity 41 and the outer folded brim 9 of the annular flat cap 7. This gap 50 helps prevent the heavy pressure exerted by the punch 44 from damaging the snap button female member 1.

With the construction of the female member of the snap button set forth hereinabove, the resilient annular flange of the cylindrical body can endure the strain caused by the punch during the clinching operation without causing any permanent deformation, thereby causing no gap between the cylindrical body and the cap. As a result, the cylindrical body and the cap remain firmly retained to each other so that the snap button is quite exempt frown unravelling or otherwise damaging of the fabric piece which would be caused by the accidental rotation of the cap on the cylindrical body in the conventional snap button.

Furthermore, a gap provided between the flat rim portion of the annular flange and the inner periphery of the annular cap advantageously ensures that the annular flange of the cylindrical body can accomplish resiliency even under heavy pressure exerted by the punch.

With the construction of the press tool set forth hereinabove, since a cylindrical hub on which a punch pressure focuses is supported by a spring ring which is in turn supported by the annular step of the die, the annular space is immune from deformation.

Obviously, various modifications and variations of the present invention are possible in the light of the above teaching. It is therefore to be understood that within the scope of the appended claims the invention may be practiced otherwise than as specifically described.

What is claimed is:

1. In a snap button including a female member and a male member engageable therewith, the female member comprising a hollow cylindrical body including a cylindrical hub and an annular flange extending radially outwardly from and integrally formed with the lower end of the cylindrical hub and terminating in a flat rim, the annular flange having an annular abutting portion formed between the lower end of the cylindrical hub and the flat rim, the flat rim and the annular abutting portion being spaced axially of the hollow cylindrical body; an annular cap having a through hole formed centrally therethrough to define an inner rim therearound and an outer folded brim formed around an outer edge thereof, the folded outer brim coming into gripping engagement with the annular flange so that the annular cap is fastened to the hollow cylindrical body with an inner surface of the annular cap abutting on the abutting portion and with an annular space provided between the lower end of the cylindrical hub and the inner rim of the annular cap; and an annular spring disposed in the annular space.

2. A female member according to claim 1, the annular flange terminating short of the inner periphery of the folded outer brim to provide a gap between the the flat rim portion of the annular flange and the inner periphery of the folded outer brim.

* * * * *